US008333091B1

(12) United States Patent
Worley

(10) Patent No.: US 8,333,091 B1
(45) Date of Patent: Dec. 18, 2012

(54) GARAGE DOOR LOCK

(76) Inventor: David Alan Worley, North Las Vegas, NV (US)

( * ) Notice: Subject to any disclaimer, the term of this patent is extended or adjusted under 35 U.S.C. 154(b) by 187 days.

(21) Appl. No.: 12/592,972

(22) Filed: Dec. 7, 2009

Related U.S. Application Data

(60) Provisional application No. 61/274,379, filed on Aug. 17, 2009.

(51) Int. Cl.
*E05B 65/08* (2006.01)

(52) U.S. Cl. ..... 70/95; 70/14; 70/34; 70/56; 49/449

(58) Field of Classification Search ..... 70/14, 33, 70/34, 54–56, 94, 95, 99, 100; 49/197, 449
See application file for complete search history.

(56) References Cited

U.S. PATENT DOCUMENTS

| | | | | | |
|---|---|---|---|---|---|
| 329,340 | A * | 10/1885 | Roelops | 70/95 |
| 2,050,695 | A * | 8/1936 | Fetyk | 70/95 |
| 2,172,208 | A * | 9/1939 | Kurtzon | 70/14 |
| 3,071,957 | A * | 1/1963 | Golub | 70/90 |
| 3,863,965 | A * | 2/1975 | Vickers | 292/66 |
| 3,922,893 | A * | 12/1975 | Berg | 70/13 |
| 4,017,105 | A * | 4/1977 | Paxton | 292/288 |
| 4,170,885 | A * | 10/1979 | Lundgren | 70/97 |
| 4,345,448 | A * | 8/1982 | Solomon | 70/95 |
| 4,438,641 | A * | 3/1984 | Levkov | 70/95 |
| 4,599,875 | A * | 7/1986 | De Forrest | 70/95 |
| 4,819,379 | A * | 4/1989 | Kenzelmann et al. | 49/280 |
| 4,875,349 | A * | 10/1989 | Girard | 70/95 |
| 5,224,297 | A * | 7/1993 | Watkins | 49/449 |
| 5,331,766 | A * | 7/1994 | Bennett | 49/449 |
| 5,458,383 | A * | 10/1995 | Gunn | 292/148 |
| 5,489,130 | A * | 2/1996 | Clark | 292/66 |
| 5,806,352 | A * | 9/1998 | Axford | 70/56 |
| 7,032,418 | B2 * | 4/2006 | Martin et al. | 70/99 |
| 7,047,774 | B1 * | 5/2006 | Gogel | 70/32 |
| 7,600,344 | B2 * | 10/2009 | Michaud | 49/322 |
| 7,707,861 | B2 * | 5/2010 | Xavier et al. | 70/33 |
| 7,784,520 | B2 * | 8/2010 | Paulson | 160/201 |
| 2004/0006920 | A1 * | 1/2004 | Zimmerman et al. | 49/449 |
| 2004/0211230 | A1 * | 10/2004 | Recknagel et al. | 70/34 |
| 2005/0044793 | A1 * | 3/2005 | Hormann | 49/197 |
| 2005/0056062 | A1 * | 3/2005 | Gogel | 70/56 |
| 2008/0196454 | A1 * | 8/2008 | Frantz | 70/14 |
| 2011/0203333 | A1 * | 8/2011 | Jimenez | 70/95 |

* cited by examiner

*Primary Examiner* — Suzanne Barrett
(74) *Attorney, Agent, or Firm* — Kenehan & Lambertsen, Ltd.; John C. Lambertsen

(57) ABSTRACT

Garage Door Track Lock to prevent overhead opening garage door from opening. Lock with Z Flange is placed securely through garage door vertical track on one side with back plate and shackle inserted through lock cylinder on opposing side and is securely in place above roller. When the lock secured in this way it prevents garage door opening. Lock cannot be cut with bolt cutters or pried off. Garage Door will be able to open when lock is unlocked with a key. The lock uses a Z Flange welded on Master Lock M46XKAD (or equivalent) and a round back plate is welded to the Master Lock shackle.

5 Claims, 4 Drawing Sheets

GARAGE DOOR LOCK

CROSS REFERENCE TO RELATED APPLICATIONS

I claim the benefit of the Provisional Application Number 61/274,379 filed on Aug. 17, 2009.

BACKGROUND

1. Field

This application relates to an improved garage door lock, specifically a way to lock a garage door with a simple lock attached to the garage track. I, Dave Worley, came upon the idea of the garage door lock when I was going on vacation. This started in the summer of 2005. I heard people complaining about their house being robbed and the thieves taking stolen items through the open garage door by simply opening it. They even steal the extra car. First I put a piece of metal with a hole drilled in it and bolts and washer on the other side of the roller track. I then started working with locking mechanisms with a piece of metal on one side of the roller track and a bolt shaft on the other side. I worked on four different prototypes until in 2009 I was satisfied with the best way I could make the garage door track lock with a Lock with Z Flange is placed securely through garage door vertical track on one side with back plate and shackle inserted through lock cylinder on opposing side and is securely in place above roller.

2. Discussion of Prior Art

The locks that were looked at required parts to be affixed to the garage door or cumbersome lock mechanisms like U.S. Pat. Nos. 4,031,719 and 5,458,383. Others are electronic and radio controlled such as U.S. Pat. Nos. 4,668,899 and 4,819,379. My lock can be simply and directly locked to the garage door vertical track and the garage door cannot be opened. My lock can be removed from the track with just a key to unlock the lock. When the lock is removed no change has been made to the garage door.

SUMMARY

Garage Door Track Lock to prevent garage door from opening. Lock with Z Flange of stainless steel is placed securely through garage door vertical track on one side with back plate of stainless steel and shackle inserted through lock cylinder on opposing side of garage door vertical track and is securely in place above roller. When the lock secured in this way it prevents garage door opening. Lock cannot be cut with bolt cutters or pried off. Garage Door will be able to open when lock is unlocked with a key. The lock uses a Z Flange welded on Master Lock M46XKAD (or equivalent) and a round back plate is welded to the Master Lock shackle. This is a lock small enough to be unnoticeable. It is custom fit lock that fights snugly to the garage vertical track and cannot be pried off. The lock has a back plate that fits flush with the back of the track as to prevent bolt cutters from being used to remove the lock. It has a Z Flange with Master Lock M46XKAD (or equivalent) which is constructed of stainless steel for strength and durability.

DESCRIPTION OF THE PREFERRED EMBODIMENTS

Figure 1:
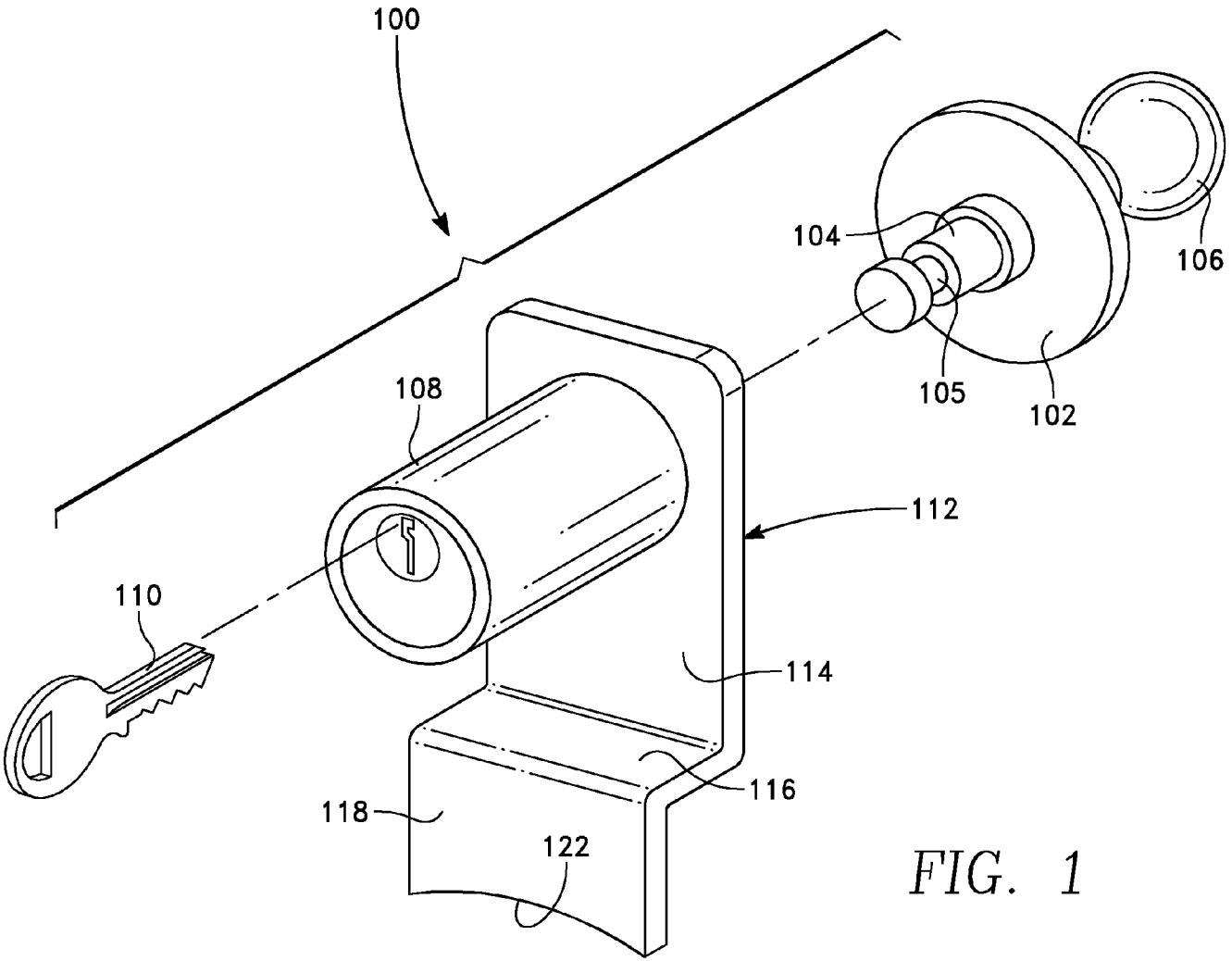
FIG. 1 is the side view of the lock cylinder with Z Flange of stainless steel and the lock shackle with back plate of stainless steel. A key shown is used to unlock the lock.

FIG. 1 is an exploded perspective view of a garage door track lock 100 showing a lock cylinder 108 and depicting a Z flange 112 of stainless steel. A key 110 is provided and used to unlock the lock cylinder 108. A back plate 102 of stainless steel is welded to the lock shackle 104 enabling it to fit snugly behind a vertical garage door track 134 and through the lock cylinder 108.

Figure 2:
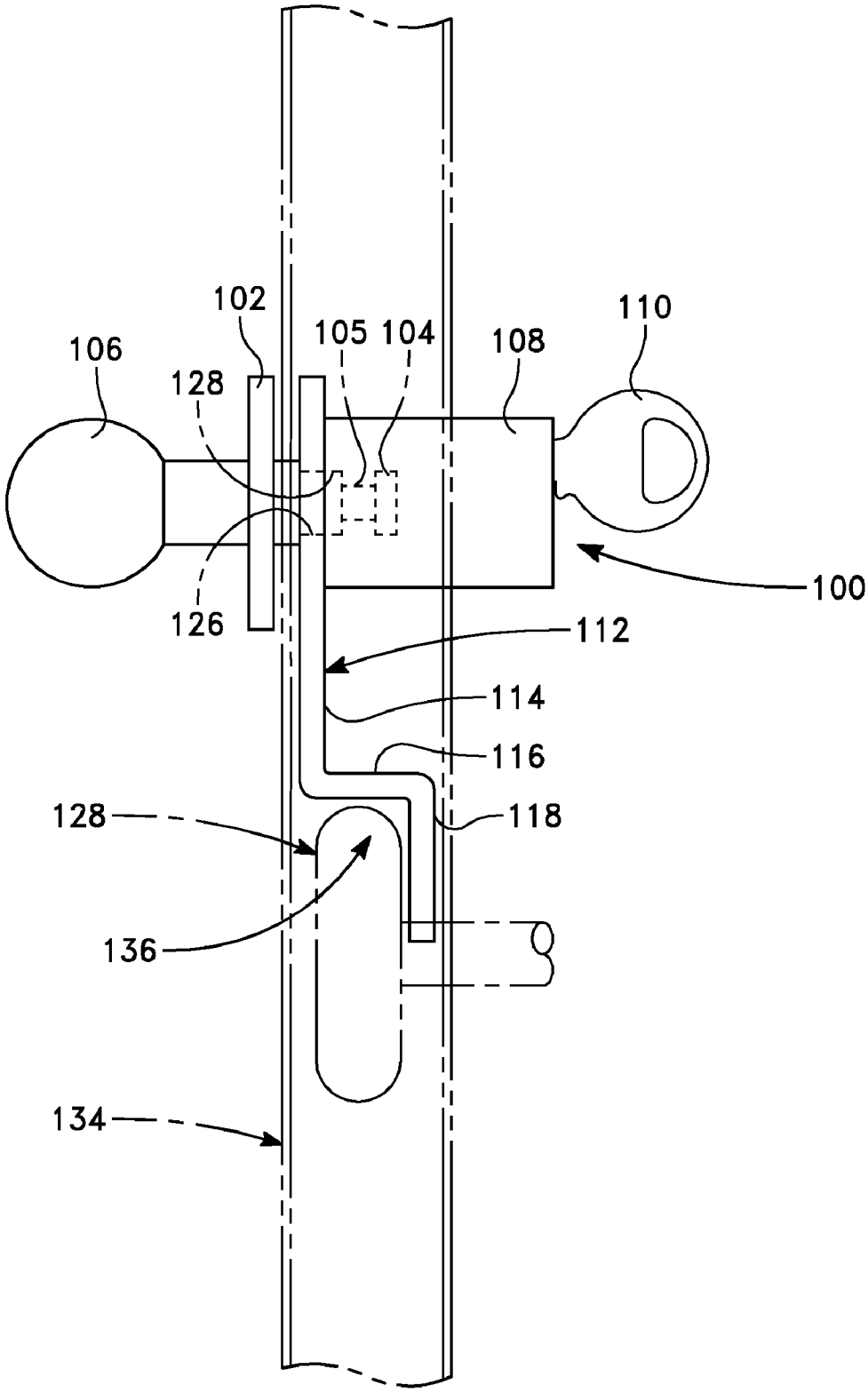
FIG. 2 is the side view showing lock with Z flange over front of track and on top of track roller and shackle with back plate.

FIG. 2 is a partial side elevation view, with portions shown in phantom, of the garage door track lock 100 showing the lock cylinder 108 and a Z flange 112, as if received within the garage door track 134. The Z flange 112 includes an offset 116 and an extension 118 that together fit over a garage door track roller 128 received within the garage door track 134. The back plate 102 welded to the lock shackle 104 is positioned to fit snugly behind the vertical garage door track 134 when the lock shackle 104 extends through the garage door track 134 and into the lock cylinder 108.

Figure 3:
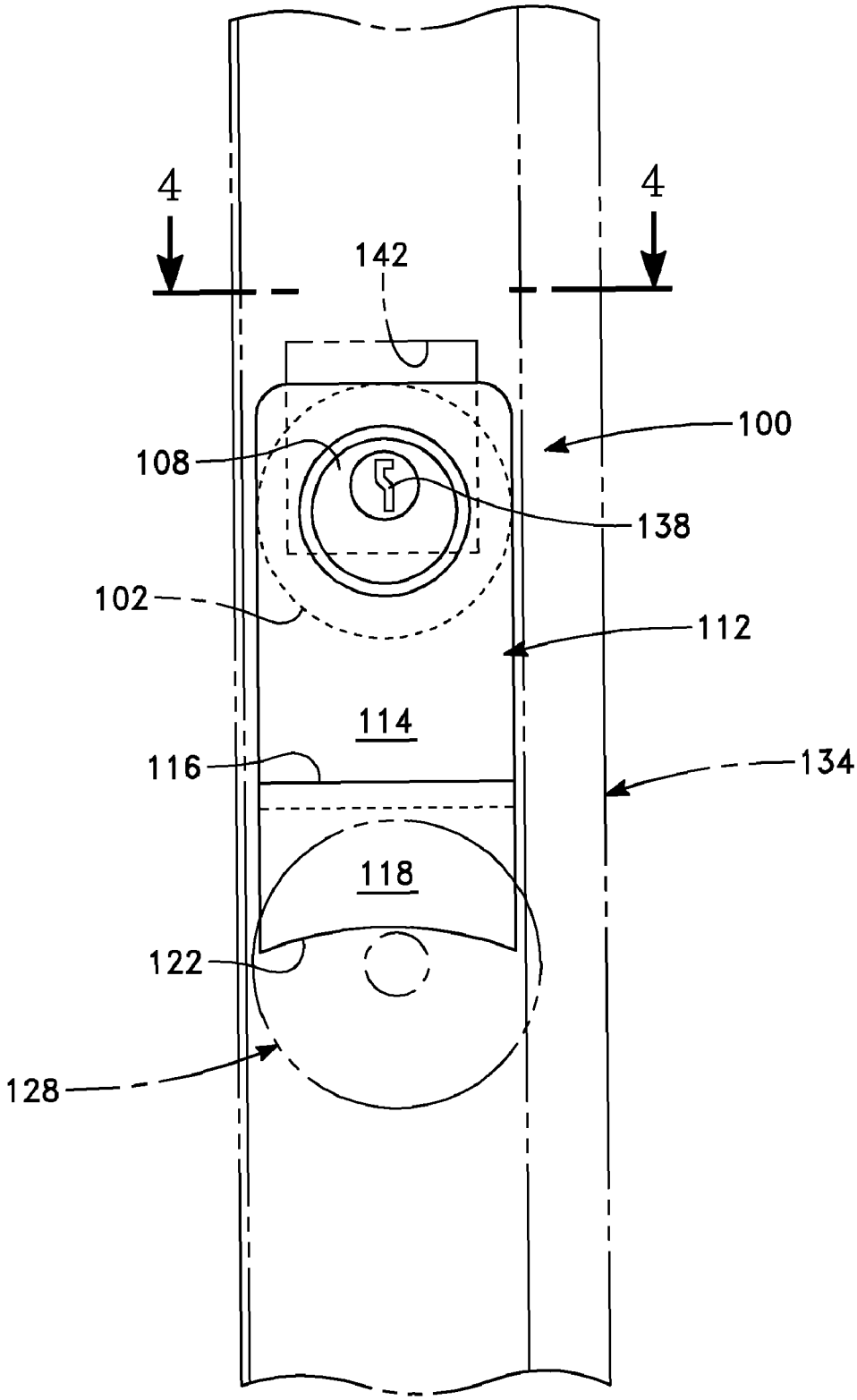
FIG. 3 is the front view showing the lock cylinder and z flange fitting snugly over roller and in door track.

FIG. 3 is a partial side elevation front view of garage door track lock 100, similar to FIG. 2, showing the lock cylinder 108 with a key hole 138 and depicting the Z flange that has a curved bottom 122 with the extension 118 that fits over the track roller 128 of the garage door track 134.

Figure 4:
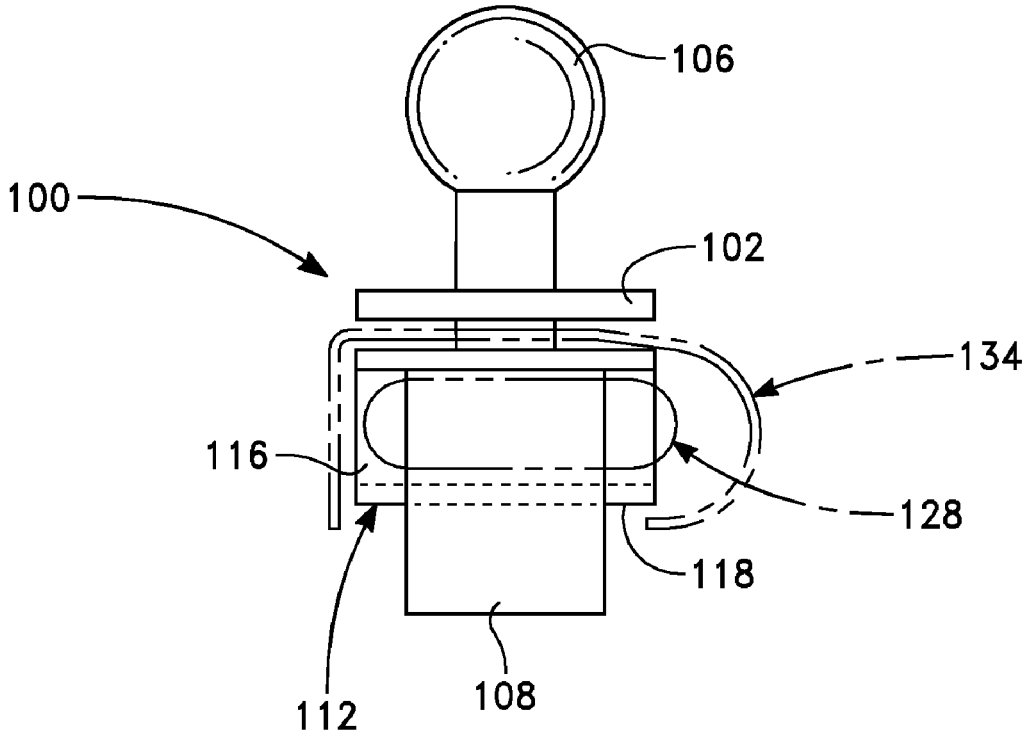
FIG. 4 depicts shackle with back plate on back of door track.

FIG. 4 is a sectional view taken along line 4-4 in FIG. 3, with portions shown in phantom, showing the garage door track lock 100 as received within the garage door track 134. The back plate 102 welded to the lock shackle 104 is shown fitting snugly behind the garage door track 134 as the lock shackle 104 extends through a rectangle opening 142 (see FIG. 3) of the vertical garage door track 134. In this manner the lock shackle 104 and the back plate 102 fit snugly behind the vertical garage door track 134 and through the lock cylinder 108.

DETAILED DESCRIPTION OF INVENTION

The best and simplest way to make a garage door track lock is first obtain a Master Lock M46XKAD (or equivalent of stainless steel) and weld a Z flange of stainless steel toward the back of the lock cylinder. Make sure when you have the lock in place the bottom of the Z flange which curves rests on the vertical track roller and will not move. Weld a back plate of stainless steel on the lock shackle so that when the shackle is securely locked through the opening in the garage door vertical track and into the lock cylinder that there is no movement or play. Then the lock cannot be pried off or a saw cannot be used to cut through the shackle and remove the lock.

OPERATION OF INVENTION

The best way to install the garage door track lock is to unlock the lock with a key. Place the Garage Door Track Lock with the lock cylinder and Z flange on the inside of the garage door track and rest the Z flange on the track roller. Lock the shackle and back plate through the opening of the garage door vertical track and into the back of the lock cylinder. The lock in now securely in place.

CONCLUSION, RAMIFICATIONS, AND SCOPE

This garage door track lock is simple yet effective. Use this lock and thieves cannot open your garage lock electronically or manually. You do not have to drill, install or change the original garage or walls in any way. This lock is easy to lock onto the garage door track to prevent the garage door from opening, it is made primary of steel which will make the product strong and last a long time, it will fit snug in and on back of the garage track to prevent the lock from being cut or pried off, small enough to go unnoticed.

The invention claimed is:

1. A garage door track security lock assembly comprising:

a lock cylinder having a longitudinal axis, said lock cylinder having a key-receiving aperture formed in a first end and a shackle-receiving aperture formed in a second end;

a retaining plate of substantially planar configuration attached to said second end of said lock cylinder in a manner wherein said retaining plate is substantially perpendicular to said longitudinal axis of said lock cylinder, said retaining plate having a shackle aperture formed therein at a location in said retaining plate such that said shackle aperture is co-located with said shackle-receiving aperture formed in said lock cylinder;

a lock shackle having a lock-engaging groove formed therein, said lock shackle releasably received within said shackle-receiving aperture of said lock cylinder;

a back plate attached to said lock shackle at a location spaced from said lock-engaging groove, said back plate extends from said lock shackle in a substantially perpendicular manner, and wherein said back plate is configured as a substantially circular plate; and a grip formed in said shackle at a terminus thereof, opposite an end of said lock shackle received within said shackle-receiving aperture of said lock cylinder, wherein said back plate extends from said lock shackle at a location intermediate said lock-engaging groove and said grip.

2. The garage door track security lock assembly of claim 1, wherein an offset is formed in said retaining plate, said offset extends from said retaining plate in a substantially perpendicular manner and in a direction substantially parallel to said lock cylinder.

3. The garage door track security lock assembly of claim 2, wherein an extension is formed in said retaining plate at a terminus of said offset, said extension extends from said offset in a substantially perpendicular manner and in a direction away from and substantially perpendicular to said longitudinal axis of said lock cylinder.

4. The garage door track security lock assembly of claim 3, wherein said offset and said extension cooperatively capture a track roller when said garage door track security lock assembly engages a garage door track.

5. The garage door track security lock assembly of claim 4, wherein a radius is formed at a terminus of said extension.

* * * * *